US011243038B1

(12) United States Patent
Langner

(10) Patent No.: US 11,243,038 B1
(45) Date of Patent: Feb. 8, 2022

(54) SYSTEMS AND METHODS FOR LAUNCHING A PROJECTILE FROM A DISRUPTER CANNON

(71) Applicant: Concept Development Corporation, Fountain Hills, AZ (US)

(72) Inventor: F. Richard Langner, Fountain Hills, AZ (US)

(73) Assignee: Concept Development Corporation, Fountain Hills, AZ (US)

( * ) Notice: Subject to any disclaimer, the term of this patent is extended or adjusted under 35 U.S.C. 154(b) by 0 days.

(21) Appl. No.: 17/148,811

(22) Filed: Jan. 14, 2021

Related U.S. Application Data

(60) Provisional application No. 63/001,172, filed on Mar. 27, 2020.

(51) Int. Cl.
*F41A 21/00* (2006.01)
*F41A 21/10* (2006.01)
*F42D 5/04* (2006.01)

(52) U.S. Cl.
CPC ..... *F41A 21/10* (2013.01); *F42D 5/04* (2013.01)

(58) Field of Classification Search
CPC ..... F42D 5/04; F41B 9/0046; F41A 25/00; F41A 21/48; F41A 21/484; F41A 21/10; F41A 21/487; F41A 25/02; F41A 25/06; F41A 5/14; F42B 33/062
USPC ..... 42/75.01–76.1
See application file for complete search history.

(56) References Cited

U.S. PATENT DOCUMENTS 5,140,892 A * 8/1992 Koine ..... F41A 7/08 89/13.05
7,523,581 B1 * 4/2009 Leutenegger ..... F41A 21/40 42/1.06
8,276,305 B1 * 10/2012 Leutenegger ..... F41A 21/40 42/79
8,915,004 B1 * 12/2014 Langner ..... F42B 33/06 42/69.01
9,322,625 B1 * 4/2016 Langner ..... F42B 33/062
10,054,388 B1 * 8/2018 Langner ..... F41B 9/0075
10,126,106 B1 * 11/2018 Langner ..... F42D 1/043
10,495,433 B1 * 12/2019 Langner ..... F42D 5/04
2009/0320346 A1 * 12/2009 Gablowski ..... F41A 21/484 42/70.11
2012/0180644 A1 * 7/2012 Langner ..... F42D 5/04 89/42.01
2014/0245878 A1 * 9/2014 Langner ..... F41A 5/14 86/50
2021/0041205 A1 * 2/2021 Vabnick ..... F41H 11/12

* cited by examiner

*Primary Examiner* — Michael D David
(74) *Attorney, Agent, or Firm* — Letham Law Firm PLLC; Lawrence Letham

(57) ABSTRACT

A disrupter cannon includes a barrel for launching a projectile. An insert may be used to launch a projectile of a smaller diameter than the projectile launched through the barrel of the disrupter cannon. An insert includes a bore therethrough, a breech-end portion, and a muzzle-end portion. The breech-end portion includes a channel. An O-ring is positioned in the channel of the breech-end portion. The muzzle-end portion includes one or more channels. A respective O-ring is positioned in each channel of the muzzle-end portion. While the insert is positioned in the barrel, the O-rings are configured to form a seal between an outer surface of the insert and an inner surface of the barrel. The projectile with a smaller diameter is launched through the bore of the insert.

20 Claims, 4 Drawing Sheets

SYSTEMS AND METHODS FOR LAUNCHING A PROJECTILE FROM A DISRUPTER CANNON

FIELD OF THE INVENTION

Embodiments of the present invention relate to disrupter cannons used to disable explosive devices.

BACKGROUND OF THE INVENTION

Disrupter cannons are used by military, bomb squad, and other emergency service personnel to destroy and/or disable explosive devices including improvised explosive devices ("IED"), bombs, and ordinance.

Disrupter cannons propel a projectile and/or a liquid to impact the explosive device. Impact of the projectile with the explosive device may interfere with (e.g., damage, destroy) a portion of the explosive device to disable the explosive device. Impact of the projectile with the explosive device may trigger (e.g., start, initiate, cause) explosion of the explosive device thereby destroying the device.

Disrupter cannons may benefit from improvements, according to the various aspects of the present disclosure, that allows the cannon to support projectiles and cartridges of different calibers, and to provide greater range of operation.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
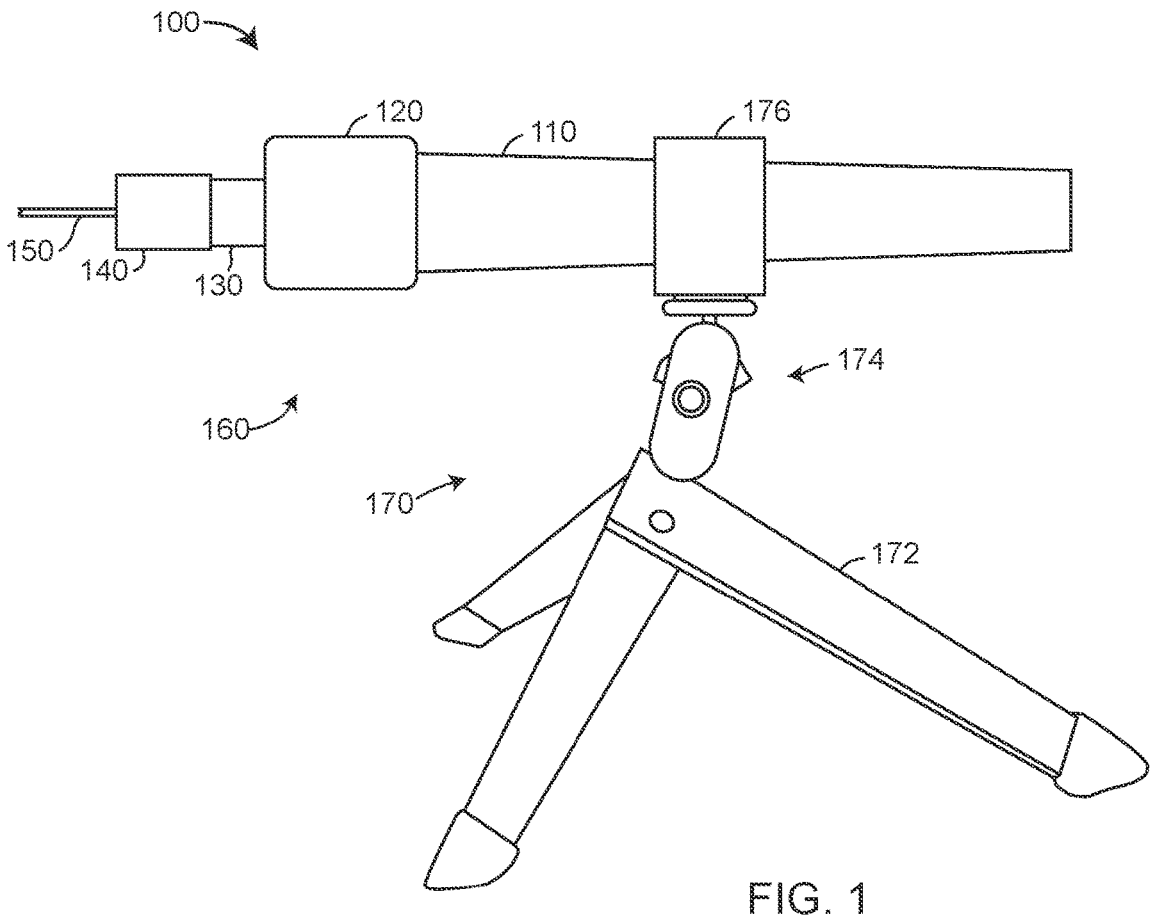
FIG. 1 is a plan view of a disrupter system.
Figure 2:
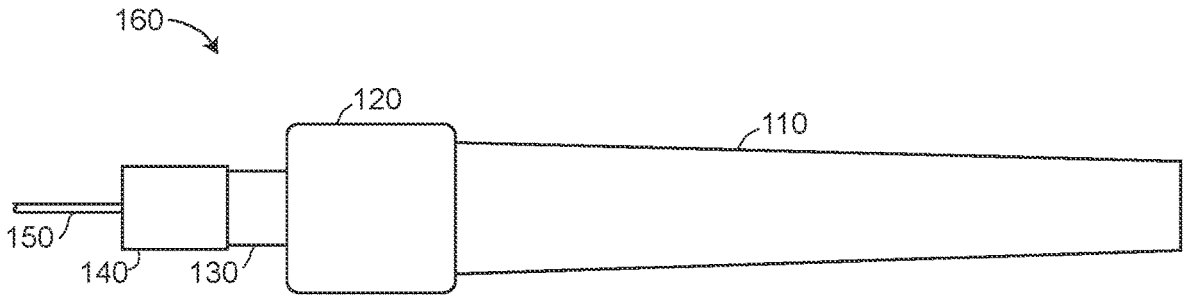
FIG. 2 is a plan view of a disrupter cannon according to various aspects of the present invention.

The disclosure of U.S. Pat. No. 9,322,625 (application Ser. No. 14/809,584) is incorporated herein by reference for any purpose.

Disrupter system 100 may be used to disable and/or destroy explosive devices. Disrupter system 100 includes disrupter cannon 160 and mount 170. Disrupter cannon 160 may propel a projectile for disabling and/or destroying an explosive device. Mount 170 positions and supports disrupter cannon 160 for propelling a projectile toward an explosive device.

Mount 170 includes holder 176, positioner 174, and tripod 172. Holder 176 is configured to hold (e.g., supports) disrupter cannon 160. Holder 176 couples to positioner 174. Holder 176 may retain disrupter cannon 160 prior to firing disrupter cannon 160. Holder 176 may release disrupter cannon 160 responsive to a recoil force to allow disrupter cannon 160 to separate from holder 176 and thereby from mount 170.

Positioner 174 may move to position (e.g., aim, orient) disrupter cannon 160. Positioner 174 may move to position holder 176 which in turn positions disrupter cannon 160. Positioner 174 may aim disrupter cannon 160 at an object, such as an explosive device. Positioner 174 may aim disrupter cannon 160 so that the trajectory of the projectile launched by disrupter cannon 160 is directed toward an explosive device. Positioner 174 may be positioned to orient disrupter cannon 160 so that the muzzle of barrel 110 is oriented in an upward, a downward, or a horizontal position with respect to the ground (e.g., toward a force of gravity). The position of positioner 174 may be locked (e.g., secured) to retain the orientation (e.g., aim) of disrupter cannon 160.

Tripod 172 supports the weight of disrupter cannon 160, holder 176, and positioner 174. Tripod 172 may include any conventional tripod or support for supporting conventional equipment (e.g., cameras, guns, cannons). Tripod 172 may include any number of legs or supports that contact the ground. Tripod 172 may be positioned (e.g., located) a distance away from the target (e.g., explosive device). The distance tripod 172 is positioned away from the target is related to the range of the projectile launched by disrupter cannon 160. Tripod 172 may move responsive to a recoil force of firing disrupter cannon 160. In an implementation where disrupter cannon 160 separates from holder 176 due to a force of recoil, tripod 172 may remain unmoved before, during and/or after firing disrupter cannon 160.

Disrupter cannon 160 may include cover 140, firing assembly 130, breech cap 120, and barrel 110. Disrupter cannon 160 may further include, according to various aspects of the present disclosure, an insert (e.g., insert 400). An insert is a structure that performs the functions of a barrel. An insert inserts into (e.g., moves into, is positioned inside) barrel 110. A maximum outer diameter of an insert must be such that the insert may be positioned in the bore (e.g., bore 370) of barrel 110. The maximum outer diameter of the insert must be less than the diameter of the bore of barrel 110. In other words, the diameter of the bore of barrel 110 is greater than the outer diameter of the insert. An insert includes a bore therethrough. A projectile may be launched through the bore of the insert, thereby permitting the insert to function as a barrel.

While an insert is positioned in the bore of barrel 110, a projectile may not be launched through the bore of barrel 110. While an insert is positioned in the bore of barrel 110, a projectile may be launched through the bore of the insert. The insert may be removed from the bore of barrel 110, so that a projectile may be launched through the bore of barrel 110.

As used herein, the term disrupter barrel refers to barrel 110 whether or not an insert (e.g., insert 400) is inserted into the disrupter barrel. The term insert barrel refers to the barrel formed by the insert (e.g., insert 400). Insert 400 may also be referred to as insert barrel 400.

Figure 3:
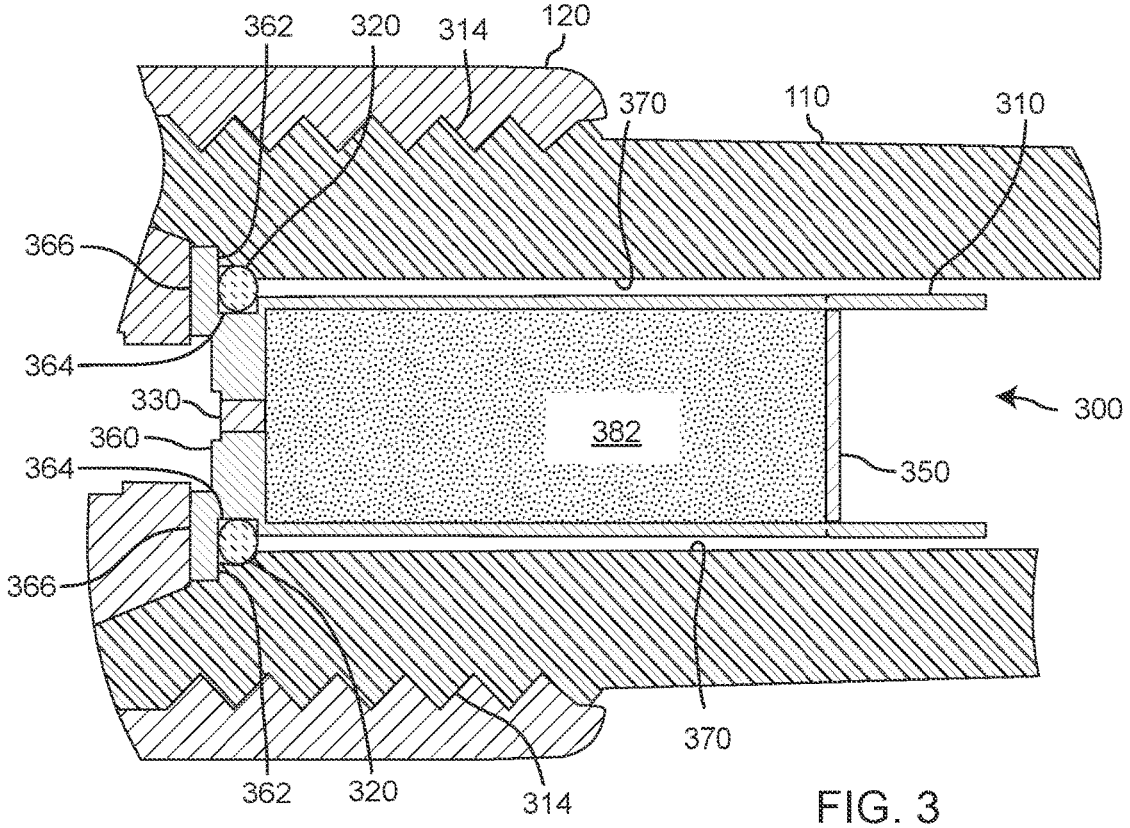
FIG. 3 is a cross-section view of the disrupter cannon of FIG. 2 along a central axis.
Figure 6:
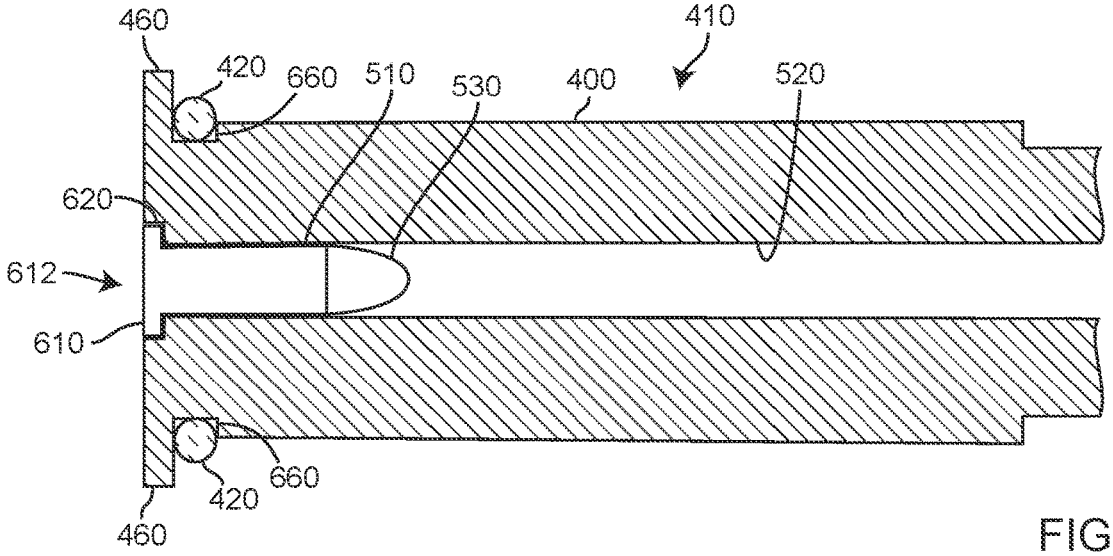
FIG. 6 is a close-up, cross-section view of the breech-end portion of the insert of FIGS. 4 and 5 along a central axis.

In an implementation, disrupter cannon 160, with or without an insert barrel inserted, may cooperate with shock tube 150 and a cartridge to launch a projectile. While an insert is not inserted into disrupter barrel 110, cartridge 300 may cooperate with shock tube 150 to launch a projectile (not shown in FIG. 3) from disrupter barrel 110. While insert 400 is inserted into disrupter barrel 110, shock tube 150 may cooperate with cartridge 510 to launch projectile 530 from insert 400. Projectile 530 exits insert 400 at exit (e.g., muzzle) 490.

A barrel, whether a disrupter barrel or an insert barrel, includes a muzzle-end (e.g., exit), a breech-end (e.g., rear), and a bore (e.g., bore 370, bore 520) therebetween. Prior to firing, the bore of the barrel holds (e.g., contains) a projectile and a cartridge. The projectile may be coupled to the cartridge (e.g., cartridge 510 and bullet 530) or the projectile may be separate from the cartridge (e.g., cartridge 300, projectile not shown). Upon firing the cartridge, the barrel in cooperation with breech cap 120, contains, at least in part and/or for a period of time, the force provided by burning a pyrotechnic of the cartridge. The burning pyrotechnic provides a rapidly expanding gas. The barrel and breech cap direct the force of the rapidly expanding gas against the projectile. The force moves the projectile along the bore toward the muzzle-end of the barrel until the projectile exits the barrel. The barrel establishes, at least at first, an initial flight trajectory of the projectile. The projectile continues along the trajectory, at least for a time, after the projectile exits the barrel. A material for a barrel may include a lightweight composite material and/or a metal.

A diameter of the bore of a barrel permits passage of the projectile through and out the barrel. A diameter of a projectile must be less than a diameter of the bore of the barrel. The diameter of the bore may be suitable for launching convention projectiles (e.g., bullet, shell). In an implementation, disrupter barrel 110 receives a conventional 12-gauge shotgun shell and launches a projectile whose diameter corresponds to the diameter of a 12-gauge barrel. In another implementation, insert barrel 400 receives a conventional .380 ACP cartridge and launches a .380-caliber bullet. In another implementation, insert barrel 400 receives a conventional 45 ACP cartridge and launches a 45-caliber bullet.

A surface of a bore of a barrel, whether the bore of disrupter barrel 110 or the bore of insert barrel 400, may be smooth or rifled. In an implementation, the bore of disrupter barrel 110 is smooth while the bore of insert barrel 400 is rifled. In another implementation, the bore of disrupter barrel 110 and the bore of insert barrel 400 are both rifled. A length of a barrel for a disrupter cannon may be in the range of 10 inches to 30 inches. In an implementation, the length of disrupter barrel 110 is 12 inches, but it is configured to couple to a 6-inch extension to provide an overall length of 18 inches, so in an implementation, the length of disrupter barrel may be 12 or 18 inches. A disrupter barrel may be any length, preferably greater than 12 inches.

An insert may be any length. A length of an insert inserted into a disrupter barrel may be more of less than the length of the barrel of the disrupter cannon. An insert barrel may be shorter or longer than the length of the disrupter barrel into which it is inserted. In an implementation, the length of insert 400 is about 1 inch longer than barrel 110, so the muzzle-end of insert 400 extends slightly from barrel 110.

In an implementation, disrupter barrel 110 is formed of titanium with an external surface of barrel 110 wrapped in carbon fiber. In another implementation, disrupter barrel 110 is formed of steel or stainless steel. In another implementation, disrupter barrel 110 is formed of a composite material. Insert barrel 400 may be formed in whole or in part of the same materials as disrupter barrel 110. In an implementation, insert 400 is formed of stainless steel. In an implementation, insert 400 is formed of steel. Insert 400 may be substantially cylindrical. In an implementation, insert 400 is a substantially cylindrical tube of stainless steel.

An outside diameter of insert 400 may be constant or vary. In an implementation, a breech-end portion and a muzzle-end portion of insert 400 have a greater outside diameter than the other portions of insert 400. The thickness of the material of insert 400 between an outside surface of insert 400 and an inside surface of insert 400 must be sufficient to provide the strength needed to launch a projectile through the bore of insert 400. The thickness between the outside surface and the inside surface may be referred to as the wall thickness of insert 400. In an implementation, insert 400 is formed of steel and has a wall thickness of at least 0.132 inches.

Disrupter cannon 160 may propel a solid and/or a liquid projectile through barrel 110. Disrupter cannon 160 may preferably propel a solid object through insert barrel 400. The pyrotechnic that generates the rapidly expanding gas used to propel a projectile is generally held in the cartridge (e.g., cartridge 300, cartridge 510).

A breech cap couples to the breech-end of disrupter barrel 110 whether or not insert 400 is inserted into disrupter barrel 110. A breech cap forms a chamber at a breech-end of disrupter barrel 110 and also at a breech-end of insert 400, if it is inserted into disrupter barrel 110. A breech cap retains a cartridge in the breech-end of bore 370 of disrupter barrel 110 or bore 520 of insert 400. The breech cap positions the firing assembly for activating the cartridge positioned in disrupter barrel 110 or insert barrel 400. A breech cap cooperates with the barrel (e.g., 110, 400) to contain and direct the force of the rapidly expanding gas discussed above. In operation, the expanding gas provided by a cartridge cannot readily exit the chamber formed at the breech-end of the barrel, so the breech cap directs the force of the expanding gas toward the muzzle-end of the barrel and against the projectile.

A coupling between a breech cap and disrupter barrel 110 must be sufficiently strong for the breech cap to remain coupled to disrupter barrel 110 during firing of the cartridge and launch of the projectile, whether launched from disrupter barrel 110 or insert barrel 400. Any coupling mechanism (e.g., threads, bayonet, latch) that can withstand the force of the expanding gas provided by the cartridge is suitable for coupling the breech cap to disrupter barrel 110. A breech cap may be removably coupled (e.g., hinged, threaded) to disrupter barrel 110. A breech cap may be completely removable (e.g., disconnected, decoupled) from disrupter barrel 110. A breech cap may be coupled to disrupter barrel 110 while an insert is inserted into the barrel.

The coupling between a breech cap and disrupter barrel 110 must be able to be decoupled after firing the cartridge to permit a new cartridge and projectile to be inserted into the barrel (e.g., 110, 400) for a subsequent launching of a projectile. Preferably, decoupling should be able to be accomplished manually without the use of tools. A coupling that becomes difficult to decouple after a cartridge is fired reduces the frequency of firing the disrupter cannon because extra time must be used to remove the breech cap and reload the disrupter cannon.

In an implementation, breech cap 120 threadedly couples to disrupter barrel 110 using threads. Even though insert 400 does not couple to breech cap 120, coupling breech cap 120 to disrupter barrel 110 positions breech cap 120 to cooperate with the cartridge positioned in insert 400. In an implementation, threads 314 are coarse ACME (e.g., T3) threads. In another implementation, threads 314 are fine ACME threads. Breech cap 120 is manually threaded to barrel 110 to couple breech cap 120 to disrupter barrel 110. Preferably, breech cap 120 can be manually unthreaded to decouple breech cap 120 from barrel 110 after firing. The thread type may contribute to the effect the expanding gas has on the coupling between the breech cap 120 and disrupter barrel 110. Preferably, the thread type increases the likelihood of being able to manually remove, without the use of tools, breech cap 120 from disrupter barrel 110 after firing. However, other factors play a role in the ease of removing breech cap 120 from disrupter barrel 110, such as the pyrotechnic used in the cartridge, whether the casing of the cartridge is bent out of shape by firing, and the amount of gas that escapes from the cartridge into the breech-end portion of the disrupter cannon.

A firing assembly activates (e.g., fires) a cartridge to launch a projectile. A firing assembly may activate a cartridge positioned in barrel 110 or a cartridge positioned in insert 400. A firing assembly may activate the cartridge responsive to an action (e.g., ignition of shock tube 150, button press for electrical current) taken by an operator of the disrupter cannon. A firing assembly may operate as a transducer in that it transforms one form of energy into another form of energy to activate a cartridge.

For example, a firing assembly for an electrically fired cartridge may translate the movement of an operator's digit on a switch into an electrical signal that activates the cartridge. A firing assembly for a mechanically fired cartridge may translate an electrical signal or mechanical movement into movement (e.g., displacement) of a firing pin that strikes the cartridge (e.g., a primer of the cartridge) to activate the cartridge. A firing assembly may translate a force provided by an expanding gas (e.g., shock tube 150) into movement of the firing pin to strike the cartridge.

Prior to firing a disrupter cannon, the firing pin of a mechanical firing assembly is positioned away from the cartridge. To fire the cartridge, the firing pin moves toward the cartridge to strike the primer of the cartridge to fire the cartridge. Preferably, after firing the cartridge, the firing pin returns to the pre-firing position (e.g., away from the cartridge) to be ready to fire a subsequent cartridge. Preferably, the firing pin returns to the pre-firing position without manual intervention by a human. Generally, a force is applied to move the firing pin from the forward (e.g., firing) position back to the pre-firing position.

In an implementation, shock tube 150 provides a force of an expanding gas to move firing pin 590 from the pre-firing position to the firing position. The expanding gas provided by shock tube 150 is provided by burning a pyrotechnic coated on the interior bore of shock tube 150. The gas provided by the burning pyrotechnic moves along a length of shock tube 150 and exits an end of shock tube 150. The exit-end of shock tube 150 is positioned in the chamber that retains firing pin 590. The gas that exits shock tube 150 applies a force on firing pin 590 that moves firing pin 590 from a pre-firing position to a firing position. In the firing position, firing pin 590 contacts (e.g., strikes, hits) the primer of cartridge 300 or cartridge 510, if insert 400 is inserted into disrupter barrel 110. The force of contact between firing pin 590 and the primer of the cartridge is sufficient to activate the primer which in turn activates the pyrotechnic.

Cartridge 300, used to launch projectiles from disrupter barrel 110, includes casing 310, seal 320, primer 330, pyrotechnic 382, and cover 350. Casing 310 includes rear portion 360 (e.g., rim, flange). Rear portion 360 includes forward surface 362 and rear surface 366. While cartridge 300 is inserted into barrel 110, forward surface 362 contacts a surface of barrel 110 to position cartridge 300 in barrel 110. While breech cap 120 is coupled to barrel 110, a surface of breech cap 120 may contact rear surface 366 to hold cartridge 300 in position in barrel 110.

Breech cap 120, when coupled to barrel 110, may press against rear portion 360 of casing 310. Pressure from breech cap 120 may force forward surface 362 against the breech-end portion of barrel 110 thereby establishing a seal between forward surface 362 and the breech-end portion of barrel 110. Forward surface 362 may be formed of the same material that forms rear portion 360 of casing 310. Forward surface 362 may be integral with rear portion 360. Forward surface 362 may include a coating of a material (e.g., neoprene, rubber, teflon) that enhances the sealing capacity of forward surface 362 with the rear portion of barrel 110.

Contact between forward surface 362 and the breech-end (e.g., rear) portion of barrel 110 positions cartridge 300 and barrel 110. While forward surface 362 contacts the rear portion of barrel 110, cartridge 300 cannot move further forward into barrel 110. The breech-end portion of barrel 110 interferes with forward movement of cartridge 300.

Rear portion 360 may further include channel 364. Channel 364 encircles casing 310. A seal may be positioned in channel 364.

A seal forms a seal (e.g., barrier). A seal (e.g., 320, 420), separate from any possible seal between forward surface 362 and the breech-end portion of barrel 110, may impede movement of material (e.g., gas, liquid, rapidly expanding gas, byproducts of burning) from barrel 110 rearward of the seal. A seal may retain material on one side (e.g., forward side) of the seal and not permit passage of the material to the other side (e.g., rearward side) of the seal. A seal in channel 364 may reduce amount of expanding gas that passes into breech cap 120. A seal may be pliable. A seal may be deformed to confirm to a shape of a surface to form a seal with that surface. Materials for a seal include neoprene, rubber, and Teflon. A seal may form a seal with an outer surface of a casing. A seal may further form a seal with an inner surface of a barrel (e.g., surface of bore). Preferably, a seal is positioned proximate to rear portion 360 in contact with forward surface 362 and an outer surface of casing 310.

For example, seal 320 may be positioned at least partially in channel 364. Seal 320 may be positioned in channel 364 during storage, transport, and/or use of cartridge 300. While cartridge 300 is inserted into barrel 110, seal 320 contacts the outer surface of casing 310 (e.g., channel 364, forward surface 362) and a surface of barrel 110. Seal 320 establishes (e.g. forms) a seal between cartridge 300 and barrel 110. Seal 320 significantly reduces (e.g., impedes, restricts), if not entirely stops, the movement of material from barrel 110 rearward of seal 320. Further, seal 320 provides a resilient force between cartridge 300 and barrel 110 that pushes cartridge 300 out of barrel 110 thereby facilitating removal of cartridge 300 from barrel 110 when breech cap 120 is removed.

Seal 320 may be positioned at any position along a length of casing 310 to seal between casing 310 and the inner surface of barrel 110. In an implementation, seal 320 is an O-ring positioned around casing 310. In an implementation, seal 320 is an O-ring positioned in channel 364 and around casing 310.

Seal 420 may perform the functions and include the structures of seal 320 discussed above.

A casing provides the structure of a cartridge. A casing establishes a diameter (e.g., caliber) of the cartridge. A casing establishes a length of a cartridge if a projectile is not attached. A casing establishes a shape of the cartridge (e.g., substantially cylindrical). A casing includes a cavity for retaining a pyrotechnic and a bore for receiving a primer (e.g., 330, 612). A projectile may couple to a front-end portion of a casing. A projectile, coupled casing, may be positioned in the bore of a barrel in front of the casing.

A casing when positioned in a barrel positions a primer 330 to cooperate with a firing pin to fire cartridge 300. Rear portion 360 provides structure (e.g., larger diameter, rim, flange) for interfering with (e.g., contacting) the breech-end portion of barrel 110 to position cartridge 300 with respect to barrel 110. Rear portion 360 contacts a breech end portion of barrel 110 to establish the maximum amount cartridge 300 may be inserted into barrel 110. Rear portion 360 includes forward surface 362 for contacting the breech-end portion of barrel 110 to position cartridge 300. A casing may be positioned in a barrel so that a central axis of the casing is positioned coaxially (e.g., aligned) with the central axis of the bore. Because firing pin 590 is position along the axis of barrel 110, placing a cartridge in barrel 110 position the primer (e.g., 330, 612) along the same axis as firing pin 590. A cartridge that includes a primer aligned with a central axis of the cartridge is described as a center-fired cartridge.

A central axis of bore 520 of insert 400 may also align with a central axis of bore 370 of barrel 110. Cartridge 510 may also be coaxially positioned in bore 520. Because of the coaxial positioning of firing pin 590, bore 370, and bore 520, firing pin aligns with any center-fire cartridge positioned in either bore 370 or bore 520.

Seal 320 may cooperate to further align a central axis of casing 310 coaxially with the central axis of bore 370.

A cover (e.g., cover 350) closes an opening of the cartridge. A cover may seal an opening. A cover may enclose a cavity. A cover may retain a material (e.g., pyrotechnic) inside a cavity of the casing. A cover may protect a material inside a cavity during transport and handling. A cover may be removed by a force. A cover may be removed by a force provided by an expanding gas. A cover may be at least partially destroyed (e.g., torn, ripped, shredded, burned) by the force that removes the cover. A cover may be rigid. A cover may be flexible. A cover may have a uniform thickness. A cover may be formed of pieces of material, whether the same or different, that are coupled together to form the cover. A cover may include a rear portion of projectile.

While a projectile is coupled to a casing, a rear portion of a projectile may perform the functions of a cover.

In an implementation, casing 310 of cartridge 300 is cylindrical. Casing 310 may be similar in size and shape to a conventional casing of a 12-gauge shotgun cartridge. The outer diameter of the casing may be less toward a front portion as opposed to rear portion 360 (e.g., rim). Casing 310 includes a cavity for receiving pyrotechnic 382. Casing 310 includes an axial bore in rear portion 360 for receiving primer 330. In an implementation, casing 310 is formed of aluminum. In another implementation, casing 310 is formed of materials and in a manner that is comparable to the materials and manner of a conventional shotgun cartridge (e.g., shell).

In an implementation, a forward portion of cartridge 300 has a diameter of about 0.7975 inches. Rear portion 360 (e.g., rim) of cartridge 300 has a diameter of about 0.870 inches. The forward portion of cartridge 300 may be positioned in bore 370 of barrel 110. Rear portion 360 of cartridge 300 will not enter bore 370 of barrel 110, but contacts and is stopped by the breech-end portion of barrel 110.

In the above implementation, the difference between the diameter of the forward portion of cartridge 300 and the diameter of rear portion 360 is 0.0725 inches. Because forward portion of cartridge 300 is coaxial with rear portion 360, forward surface 362 is a band (e.g., rim) 0.036 inches wide around the forward surface 362 of rear portion 360. Accordingly, the 0.036-inch band is the amount of rear portion 360 that does not enter bore 370 of barrel 110. Further, the 0.036-inch band is the amount of surface of rear portion 360 that may contact the breech-end portion of barrel 110. In an implementation, cartridge 300 has a length of about 2.85 inches and the thickness of rear portion 360 (e.g., rim) is about 0.036 inches. So, all but 0.036 inches of cartridge 300 may be position in bore 370 of barrel 110.

In an implementation, casing 310, and thereby forward surface 362, are formed of aluminum. Barrel 110 is formed of titanium or stainless steel. Accordingly, the contact between forward surface 362 and the breech-end portion of barrel 110 is contact between dissimilar metals. Forward surface 362 may form somewhat of a seal with the breech-end portion of barrel 110. A force applied by breech cap 120 on rear portion 360 of cartridge 300 may increase the efficacy of any seal formed between forward surface 362 and a surface of the breech-end portion of barrel 110.

In an implementation, cartridge 300 is about the same in size, shape, and length as a cartridge for a 12-gauge shotgun. In another implementation, cartridge 300 is about the same in size, shape, and length as a cartridge for a 20-gauge shotgun. Typically, the range of a projectile launched using cartridge 300 from barrel 110 is between 6 to 48 inches, preferably 16 to 22 inches. Generally, barrel 110 has a smooth bore; however, barrel 110 may also be rifled.

At times, it is desirable to launch a projectile at a greater distance or with a smaller-diameter projectile than the range and projectile size launched using cartridge 300 through barrel 110. Projectiles of a smaller caliber and greater range may be launched from insert barrel 400 while insert 400 is inserted into disrupter barrel 110.

Insert 400 includes bore 520. Bore 520 passes completely through insert 400. Bore 520 is open at breech-end portion 410 and muzzle-end portion 480. Insert 400 together with bore 520 forms a barrel and may be referred to as insert barrel 400 as discussed above. Bore 520 may be rifled (not shown). Insert 400 may enable disrupter cannon 160 to launch a projectile (e.g., bullet) a greater distance than when insert 400 is not used and when cartridge 300 is used to launch a projectile through barrel 110. For example, insert 400 may be used to launch a .380 caliber bullet from disrupter cannon 160. The .380 caliber bullet launched from insert 400 has a range that is typical for that caliber cartridge.

Insert 400 is configured for being inserted into barrel 110 of disrupter cannon 160. Insert 400 includes breech-end portion 410 and muzzle-end portion 480. Breech-end portion 410 includes rear portion 460 (e.g., rim, flange), seal 420, and indentation 620. Breech-end portion may further include channel 660. Seal 420 encircles breech-end portion 410. Seal 420 is positioned forward (e.g., with respect to the direction of launch) of rear portion 460. Seal 420 may be positioned in channel 660. Indentation 620 is configured to contact (e.g., interfere with) a rear portion 610 (e.g., rim, flange) of cartridge 510 to position cartridge 510 in bore 520. Rear portion 610 contacts an inner surface of indentation 620 to stop the forward movement of cartridge 510 in bore 520. Indentation 620 may be circular (e.g., looking toward the breech-end portion of insert 400) to accept the rim (e.g., rear portion 460) of cartridge 510. Indentation 620 further position a primer (e.g., primer 612) of the cartridge in-line (e.g., coaxially) with firing pin 590 of disrupter cannon 160.

Preferably, breech-end portion 410 of insert 400 is sized (e.g., diameter, length, shape) similarly to cartridge 300. Just as cartridge 300 fits into bore 370 of barrel 110, breech-end portion 410 having the same size as cartridge 300 will also fit into bore 370. Sizing breech-end portion 410 to be similar in size to cartridge 300 configures breech-end portion 410 to fit into barrel 110 and to interact with (e.g., aligning to, orienting with respect to) barrel 110, breech cap 120, and firing assembly 130.

Rear portion 460 may be configured so that a front surface of rear portion 460 contacts an inner surface of barrel 110 in the same manner as forward surface 362 of cartridge 300. Rear portion 460 may be configured so that a rear surface of rear portion 460 contacts a surface of breech cap 120, similarly to rear surface 366 when breech cap 120 is coupled to barrel 110. Breech-end portion 410 may be configured to have a same length as cartridge 300.

Breech-end portion 410 may further include seal 420. Seal 420 is configured to establish a seal between an outer surface of breech-end portion 410 and an inner surface of barrel 110 similarly to seal 320.

When insert 400 is positioned in barrel 110 and breech cap 120 is coupled to barrel 110, seal 420 contacts the outer surface of breech-end portion 410 and an inner surface of barrel 110 to form a seal between breech-end portion 410 and barrel 110. Seal 420 performs the same function and serves the same purpose as seal 320. Seal 420 may reduce movement of material from barrel 110 rearward of seal 420. Seal 420 may further exert a resilient force between rear portion 460 and barrel 110 to facilitate removing insert 400 from barrel 110. In an implementation, seal 420 is an O-ring. Configuring breech-end portion 410 to have the same dimensions as cartridge 300 ensures that breech-end portion 410 fits into barrel 110 and is held secure when breech cap 120 is coupled to barrel 110.

While insert 400 is positioned in barrel 110, muzzle-end portion 480 is positioned toward the muzzle of barrel 110. Muzzle-end portion 480 includes one or more seals 482. While insert 400 is inserted into barrel 110, seals 482 are configured to be positioned between an outer surface of muzzle-end portion 480 and surface of bore 370 of barrel 110. Seals 482 may form a seal between an outer surface of muzzle-end portion 480 and an inner surface of bore 370. Seals 482 are further configured to position insert 400 with respect to barrel 110. Preferably, seals 482 position a central axis of bore 520 (e.g., central axis of insert 400, central axis of insert 400) collinearly to (e.g., aligned with) the central axis of bore 370 of barrel 110 (e.g., central axis of barrel 110). Positioning the central axis of insert 400 collinearly with the central axis of barrel 110 enables a projectile launched from insert 400 to accurately travel to the location indicated by the aiming system of disrupter system 100.

For example, if a laser used to aim barrel 110 indicates the location where a projectile launched from barrel 110 should strike, the projectile launched from insert 400 should strike the same location. Collinear aligning the axis a bore 520 with the axis of bore 370 means that the laser used to indicate the aim of barrel 110 may also be used to indicate the aim of insert 400. Because bore 520 of insert 400 is collinearly aligned with bore 370 of barrel 110, the projectile launched through insert 400 will strike the location indicated by the laser. Aligning insert 400 with barrel 110 means that disrupter cannon 160 needs only one aiming system for aiming both barrel 110 and insert 400.

When cartridge 510 is activated (e.g., fired) while insert 400 is positioned in barrel 110, the force of the rapidly expanding gas from cartridge 510 operates on (e.g., affects, applies a force to) insert 400. The rearward (e.g., recoil) movement of insert 400 is stopped by interference with breech cap 120. Seals 482 are configured to establish a resilient force between the interior of bore 370 and the exterior of insert 400 to reduce movement of insert 400 away from the central axis of bore 370. The resilient force established by seals 482 holds the central axis of bore 520 collinear with respect to the central axis of bore 370 before, during, and/or after launching projectile 530. If the resilient force provided by seals 482 is not sufficient to counter the force of launching projectile 530, insert 400 may move out of collinear alignment with barrel 110. If insert 400 moves out of collinear alignment with barrel 110, projectile 530 may not strike the location indicated by the aiming apparatus (e.g., laser, mechanical sights, optical sights) of disrupter system 100. Failure to maintain collinear alignment between bore 520 and bore 370 may result in inaccurate delivery of projectile 530.

In an implementation, seals 482 include seven O-rings. Seals 482 are separated from each other to cover a length along muzzle-end portion 480 of about 1.5 inches. In another implementation, seals 482 include two O-rings spaced apart about 1.5 inches from each other on muzzle-end portion 480. In another implementation, seals 482 include 3 O-rings separated from each other to cover a length of 1.5 inches along muzzle-end portion 480. Muzzle-end portion 480 may include one or more channels 584 in muzzle-end portion 480 for receiving one seal 482 respectively. The O-rings (e.g., 482) and the channels (e.g., 584) may be equally separated (e.g., spaced) from each other.

Figure 5:
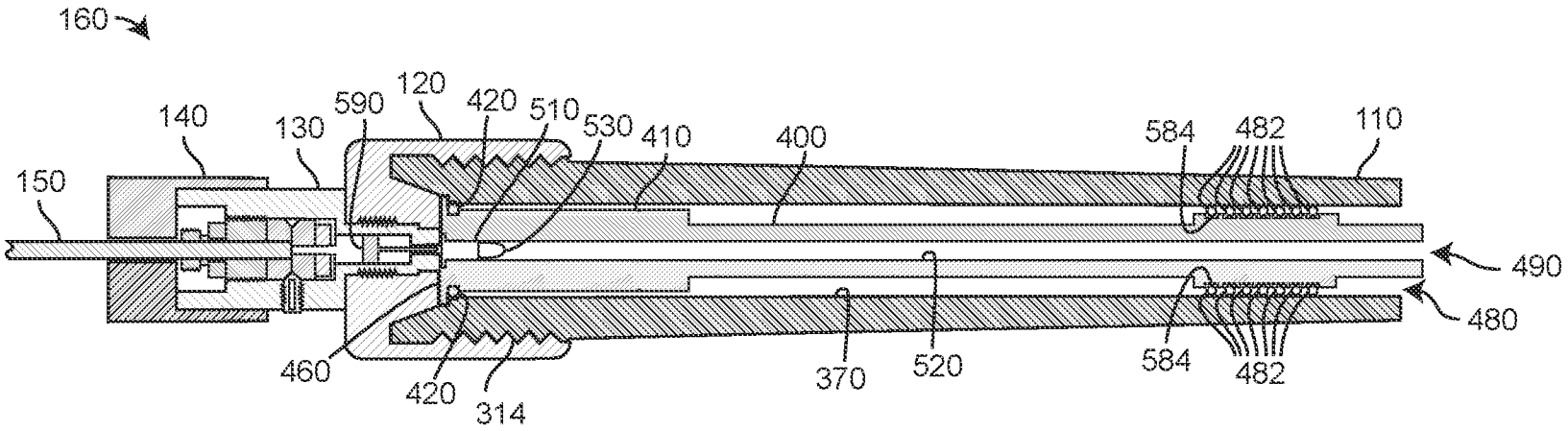
FIG. 5 is a cross-section view of the disrupter cannon of FIG. 2 and the insert of FIG. 4 along a central axis.
Figure 4:
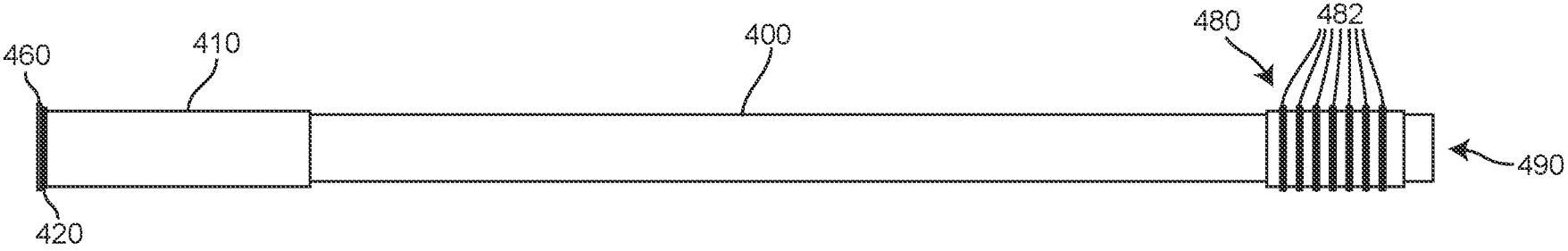
FIG. 4 is a plan view of an insert.
Figure 7:
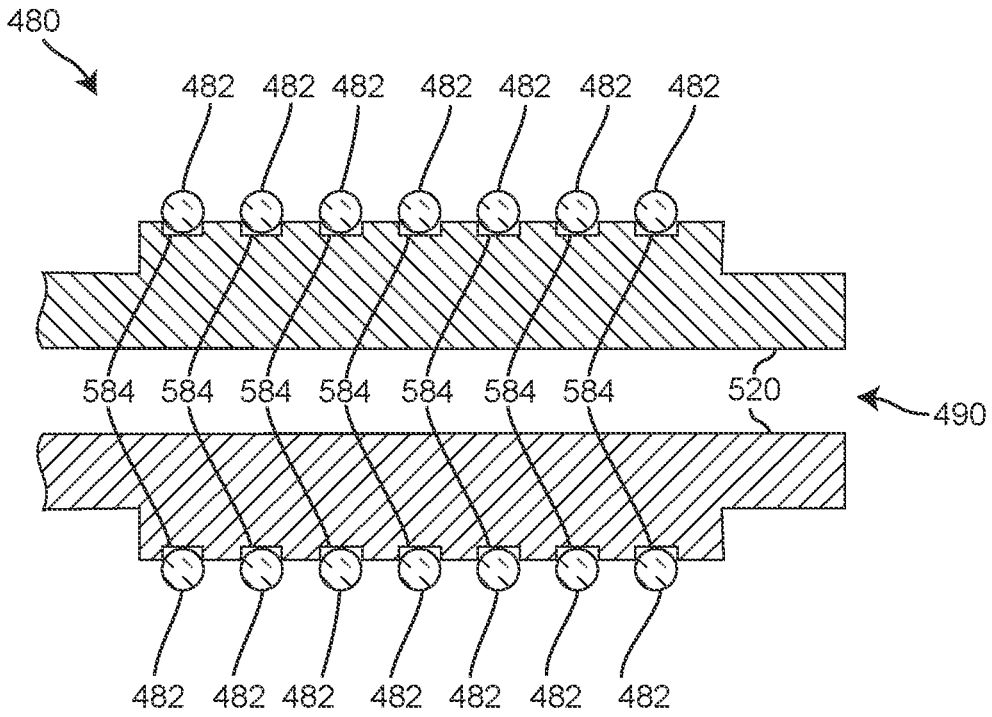
FIG. 7 is a close-up, cross-section view of the muzzle-end portion of the insert of FIGS. 4 and 5 along a central axis.

In FIGS. 4-5 and 7, seals 482 are shown only at muzzle-end portion 480 of insert 400. The positions of seals 480 are not limited to muzzle-end portion. Any number of seals may be positioned at any location along a length of insert 400. Seals 482 of different thicknesses may be positioned along a length of insert 400 to retain insert 400 collinearly aligned with barrel 110. Any device may be used to retain the position of insert 400 with respect to barrel 110.

A diameter of muzzle-end portion 480 plays a part in determining whether seals 482 provide sufficient resilient force to maintain insert 400 collinearly aligned with barrel 110. Increasing the diameter of muzzle-end portion 480 leaves less room between an outer surface of muzzle-end portion 480 and an inner surface of bore 370 of barrel 110, thereby causing seals 482 to exert increased force between barrel 110 and muzzle-end portion 480. Increased force tends to hold insert 400 increasingly steady and aligned with barrel 110. However, if seals 482 are too big (e.g., in diameter), they will not fit into bore 370. Decreasing the diameter of muzzle-end portion 480 provides more room between an outer surface of muzzle-end portion 480 and an inner surface of bore 370, thereby causing seals 482 to exert less force between barrel 110 and muzzle-end portion 480. The diameter of muzzle-end portion 480 and the diameter and/or thickness of seals 482 may be adapted to provide sufficient force to maintain insert 400 collinearly aligned with bore 370 of barrel 110 during, and/or after firing cartridge 510.

In an implementation, the inside diameter of bore 370 of barrel 110 is about 0.800 inches, the outside diameter of muzzle-end portion 480 is about 0.7975 inches, and O-rings 482 are 014 sized O-rings. The depth of channel 584 is about 0.032 inches. The above measurements have a tolerance of between ±0.0005 and ±0.001 inches. In an implementation, O-rings 482 maintain insert 400 collinear positioned with respect to barrel 110, so projectile 530 is accurately launched to strike the location indicated by the aiming apparatus of disrupter system 100.

Because bore 520 is configured to collinearly align with bore 370 of barrel 110, primer 612 of cartridge 510 also collinearly aligns with firing pin 590. Accordingly, as firing pin 590 moves from the pre-firing position to the firing position, firing pin is aligned with and strikes primer 612 to ignite (e.g., fire) cartridge 510 to launch projectile 530.

An insert is configured to fire a projectile of a particular caliber. If a projectile of a different caliber needs to be launched, a different insert needs to be used. For example, an insert configured to receive a .308 cartridge may fire a .308 bullet because the diameter of the bore of the insert is configured for a .308 cartridge and bullet. If it is desirable to launch a 45-caliber bullet, a different insert that has a bore diameter suited for a 45-caliber cartridge and bullet must be used. Different inserts may correspond to different projectile calibers. Firing a bullet of a particular caliber requires inserting an insert configured for that caliber into barrel 110. Each time a bullet of a different caliber needs to be fired, the insert of the previous caliber must be removed from barrel 110 and a different insert having the desired caliber must be inserted into barrel 110.

The portions of insert 400 that come into contact with the interior surface of barrel 110 (e.g., seal 420, seals 482, breech-end portion 410) may need to be lubricated (e.g., greased) prior to inserting insert 400 into barrel 110.

During testing of an insert, it was found that insert 400 could be inserted and positioned at any orientation with respect to barrel 110 without affecting the accuracy of delivery of the projectile or the operation of insert 400 and/or cannon 160. In other words, the orientation (e.g., rotational orientation) of insert 400 with respect to barrel 110 could be changed without improving or negatively affecting accuracy or any other operational aspect of insert 400 and/or cannon 160.

However, if desired, an insert may be consistently oriented with respect to a disrupter barrel. Repeatable orientation may be accomplished by marking (e.g., index mark) the insert with respect to the disrupter barrel, so that when the insert is inserted into the disrupter barrel and the marks aligned, the insert is repeatably positioned with respect to the disrupter barrel.

Index marks may be placed on the muzzle and/or breech ends of the insert and disrupter barrel. The insert may be inserted into the disrupter barrel and rotated until the index mark on the insert aligns with the index mark on the disrupter barrel.

A muzzle brake may also be used with respect to the operation of an insert and/or a disrupter cannon. A muzzle brake is a device that couples to the muzzle of a barrel to reduce the recoil of the barrel by directing a portion of the expanding gas upward to apply a downward force on the muzzle of the barrel.

A muzzle brake may be coupled to the muzzle of barrel 110 or insert 400. A muzzle brake may couple to barrel 110 or insert 400 in any manner. In an implementation, a muzzle brake attaches to insert 400 using threads.

In practice, insert 400 may be inserted into barrel 110. Insert 400 may extend from barrel 110. For example, in an implementation, insert 400 extends from the muzzle of barrel 110 by about one inch. The portion of insert 400 that extends from barrel 110, refer to FIG. 5, may be threaded (not shown). While insert 400 is positioned in barrel 110, the muzzle brake may be threadedly attached to the threaded end portion of insert 400. Once the muzzle brake is coupled to insert 400, insert 400 and the muzzle brake may be rotated so that the port (e.g., hole, opening) that directs the expanding gas upward is positioned up with respect to barrel 110. Once the muzzle brake has been coupled to insert 400 and oriented, insert 400 and cannon 160 may be used.

Using a muzzle brake also consistently orients (e.g., rotationally) insert 400 with respect to barrel 110 because orienting the port of the muzzle brake orients insert 400 with respect to barrel 110.

The foregoing description discusses implementations (e.g., embodiments), which may be changed or modified without departing from the scope of the present disclosure as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. While for the sake of clarity of description, several specific embodiments have been described, the scope of the invention is intended to be measured by the claims as set forth below. In the claims, the term "provided" is used to definitively identify an object that is not a claimed element but an object that performs the function of a workpiece. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

The location indicators "herein", "hereunder", "above", "below", or other word that refer to a location, whether specific or general, in the specification shall be construed to refer to any location in the specification whether the location is before or after the location indicator.

Methods described herein are illustrative examples, and as such are not intended to require or imply that any particular process of any embodiment be performed in the order presented. Words such as "thereafter," "then," "next," etc. are not intended to limit the order of the processes, and these words are instead used to guide the reader through the description of the methods.

What is claimed is:

1. An insert for launching a projectile, the insert configured to be inserted into a first bore of a provided barrel of a provided disrupter cannon, the first bore having a first diameter, the insert comprising:

a cylinder having an outside diameter, the cylinder including a breech-end portion, a muzzle-end portion, and a second bore therethrough, the second bore having a second diameter; and a plurality of O-rings; wherein:

the outside diameter is less than the first diameter;

the breech-end portion includes a first channel that encircles the breech-end portion of the cylinder, one O-ring of the plurality of O-rings is positioned in the first channel of the breech-end portion, the one O-ring encircles the cylinder;

the muzzle-end portion includes at least two second channels, each second channel encircles the muzzle-end portion of the cylinder, one O-ring of the plurality of O-rings is positioned in each second channel of the muzzle-end portion respectively, each O-ring encircles the cylinder; and while the insert is inserted into the first bore, each O-ring of the plurality of O-rings is configured to form a seal between an outside surface of the cylinder and an inside surface of the first bore.

2. The insert of claim 1 wherein the O-rings that encircle the muzzle-end portion of the cylinder are configured to align a central axis of the second bore with a central axis of the first bore.

3. The insert of claim 2 wherein the O-rings that encircle the muzzle-end portion of the cylinder are configured to maintain the central axis of the second bore aligned with the central axis of the first bore while a projectile is launched from the second bore.

4. The insert of claim 1 wherein the second diameter is less than the first diameter.

5. The insert of claim 1 wherein the cylinder formed of a metal.

6. The insert of claim 1 wherein the insert is configured to be inserted into and removed from the first bore of the provided barrel via a breech-end portion of the provided barrel.

7. The insert of claim 1 wherein the outside diameter is a maximum outside diameter of the cylinder.

8. The insert of claim 1 wherein:

the breech-end portion of the cylinder further includes a rim that encircles the breech-end portion of the cylinder; and while the insert is inserted into the provided barrel of the provided disrupter cannon, the rim is configured to interfere with a breech-end portion of the provided barrel to position the insert in the provided barrel.

9. The insert of claim 1 wherein the breech-end portion of the cylinder further includes an indentation, wherein the indentation is configured to receive a rim of a provided cartridge to position the provided cartridge in the second bore.

10. The insert of claim 1 wherein while the insert is inserted into the provided barrel of the provided disrupter cannon, a central axis of the second bore is configured to be positioned collinear with a central axis of the first bore.

11. The insert of claim 1 wherein the cylinder comprises:

a first outer diameter and a second outer diameter; and the first outer diameter is greater than the second outer diameter.

12. An insert for launching a projectile, the insert configured to be inserted into a first bore of a provided barrel of a provided disrupter cannon, the first bore having a first diameter, the insert comprising:

a cylinder having an outside diameter, the cylinder including a breech-end portion, a muzzle-end portion, and a second bore therethrough, the second bore having a second diameter, the cylinder adapted to be inserted into the first bore of the provided barrel; and a plurality of O-rings; wherein:

the outside diameter is less than the first diameter;

the breech-end portion of the cylinder includes at least one first channel that encircles the breech-end portion of the cylinder and, one O-ring of the plurality of O-rings is positioned in each of the at least one first channel respectively of the breech-end portion, each O-ring encircles the cylinder;

the muzzle-end portion of the cylinder and includes at least two second channels, each second channel encircles the muzzle-end portion of the cylinder, one O-ring of the plurality of O-rings is positioned in each second channel of the muzzle-end portion of the cylinder respectively, each O-ring encircles the cylinder; and while the insert is inserted into the first bore of the provided barrel, each O-ring of the plurality of O-rings is configured to form a seal between the cylinder and an inside surface of the first bore.

13. The insert of claim 12 wherein while the insert is inserted into the provided barrel of the provided disrupter cannon, the O-ring positioned in the at least one first channel respectively is configured to form a seal between the breech-end portion of the cylinder and an inner surface of the provided barrel.

14. The insert of claim 12 wherein while the insert is inserted into the provided barrel of the provided disrupter cannon, the one O-ring positioned in at least two second channels respectively is configured to form a seal between the muzzle-end portion of the cylinder and an inner surface of the provided barrel.

15. The insert of claim 12 wherein the O-rings that encircle the muzzle-end portion of the cylinder are configured to align a central axis of the second bore with a central axis of the first bore.

16. The insert of claim 12 wherein the O-rings that encircle the muzzle-end portion of the cylinder are configured to maintain a central axis of the second bore aligned with a central axis of the first bore while a projectile is launched from the second bore.

17. The insert of claim 12 wherein:

the breech-end portion of the cylinder further includes a rim that encircles the breech-end portion of the cylinder; and in while the insert is inserted into the provided barrel of the provided disrupter cannon, the rim is configured to interfere with a breech-end portion of the provided barrel to position the insert in the provided barrel.

18. The insert of claim 12 wherein the breech-end portion of the cylinder further includes an indentation, wherein the indentation is configured to receive a rim of a provided cartridge to position the provided cartridge in the second bore.

19. An insert for launching a projectile, the insert configured to be inserted into a first bore of a provided barrel of a provided disrupter cannon, the first bore having a first diameter, the insert comprising:

a cylinder having an outside diameter, the cylinder including a muzzle-end portion, and a second bore therethrough, the second bore having a second diameter, the cylinder adapted to be inserted into the first bore of the provided barrel; and a plurality of O-rings; wherein:

the outside diameter is less than the first diameter;

the muzzle-end portion of the cylinder includes at least two second channels, each second channel encircles the muzzle-end portion of the cylinder, one O-ring of the plurality of O-rings is positioned in each second channel of the muzzle-end portion of the cylinder respectively, each O-ring encircles the cylinder; and while the insert is inserted into the first bore of the provided barrel, each O-ring of the plurality of O-rings is configured to form a seal between the cylinder and an inside surface of the first bore.

20. The insert of claim 19 wherein the O-rings that encircle the muzzle-end portion of the cylinder are configured to maintain a central axis of the second bore aligned with a central axis of the first bore.

* * * * *